US006058629A

United States Patent [19]

Peterson et al.

[11] Patent Number: 6,058,629

[45] Date of Patent: May 9, 2000

[54] SNOWBLOWER CHUTE ASSEMBLY DRIVE

[76] Inventors: Marvin W Peterson, 107 Swale Brook La., Milford, Pa. 18337; Laura M DiMarco, 54 Glen Crest Dr., Newton, N.J. 07860

[21] Appl. No.: 09/071,724

[22] Filed: May 1, 1998

[51] Int. Cl.[7] ..... E01H 5/09

[52] U.S. Cl. ..... 37/261

[58] Field of Search ..... 37/244, 246, 249, 37/250, 251, 257, 260, 261; 74/89.18, 89.19, 435

[56] References Cited

U.S. PATENT DOCUMENTS

| | | | |
|---|---|---|---|
| 3,726,029 | 4/1973 | Deen et al. . | |
| 3,760,517 | 9/1973 | Blaauw | 37/260 |
| 3,780,455 | 12/1973 | Stevenson et al. . | |
| 3,867,773 | 2/1975 | Gunderson | 37/260 |
| 3,879,866 | 4/1975 | Gunderson | 37/260 |
| 4,138,829 | 2/1979 | Chase . | |
| 4,138,831 | 2/1979 | Chase . | |
| 4,205,468 | 6/1980 | Greider . | |
| 5,315,771 | 5/1994 | White, III et al. . | |
| 5,444,927 | 8/1995 | Sosenko | 37/260 |

*Primary Examiner*—Robert E. Pezzuto

[57] ABSTRACT

A snow chute assembly for use with a snowblower. The chute assembly includes a snow chute having a rotatable base to be attached to the snowblower and presenting a circumference with spaced apart notches formed therein. An arc of notches extends around the circumference from one end, through a mid-point, through a second end preferably through an arc of 180°–210°. A gear member as driven by a drive shaft, preferably a worm gear, engages the notches. A limit switch limits the rotation of the chute on the base, the limit switch being substantially at the mid-point of the arc notches. The limit switch will engage limit arms extending from the base. One arm being at each end of the arc of notches. A base activation member includes a drive motor for rotating the drive shaft connected to the gear member, the drive shaft rotation ceasing upon engagement of the limit switch with either limit arms.

6 Claims, 6 Drawing Sheets

SNOWBLOWER CHUTE ASSEMBLY DRIVE

FIELD OF THE INVENTION

This invention relates to an automatically controlled rotatable snow chute for use with snowblowers. More specifically, the snow chute discharges snow in a selected direction while preventing snow from being discharged in the snowblower operator's direction.

BACKGROUND OF THE INVENTION

In geographic areas that receive a large amount of annual snowfall, snow removal from driveways, sidewalks etc. is time consuming, arduous work. Snowblowers were developed to help alleviate this problem. Most snowblowers discharge snow through a chute that extends from the snowblower. Discharging the snow can be difficult when the snow piles up against adjacent walls or in comers. Furthermore, winds may pile snow in undesirable areas. A snowblower having an automatically controlled directional chute avoids these disadvantages. Although directional snow chutes have been disclosed, they can be a safety hazard by throwing snow at the operator.

SUMMARY OF THE INVENTION

Accordingly, a primary object of the subject invention is to provide an easily controlled rotating snow chute assembly having a circular gear-like base with notches formed therein that extend 180°–210° therearound and intermesh with a worm gear for rotation of the chute.

Another object of the subject invention is to provide a rotatable snow chute including a rotation limiting member mounted to the base thereof to protect the operator from discharged snow.

Yet another object of the subject invention is to provide a selectively directional snow chute for snowblowers.

A further object of the subject invention is to provide snow chute assembly controls that can be retrofitted to existing snowblowers.

A still further object of the subject invention is to provide a directional snow chute for snowblowers that is easy to assemble and operate.

These objects are attained by providing a chute assembly for a snowblower, comprising a snow chute having a rotatable base for attachment to the snowblower and presenting a circumference with spaced apart notches formed therein and extending through an arc of approximately 180°–210° around the circumference from one end, through a mid-point, to a second end; a gear member threadably engaged with the notches and rotatable about a drive shaft rotatably mounted to the snowblower; a limiting switch member for limiting rotation of the chute on the base and including a limit switch substantially at the mid-point of the arc of notches and limit arms on the base, one arm substantially at each end of the arc of notches; and an activation member including a switch connected to the limiting switch member and a drive motor connected to the gear member.

Other objects and advantages of this invention will become apparent from the following description taken in connection with the accompanying drawings, wherein is set forth by way of illustration and example, an embodiment of this invention.

DETAILED DESCRIPTION

Figure 1:
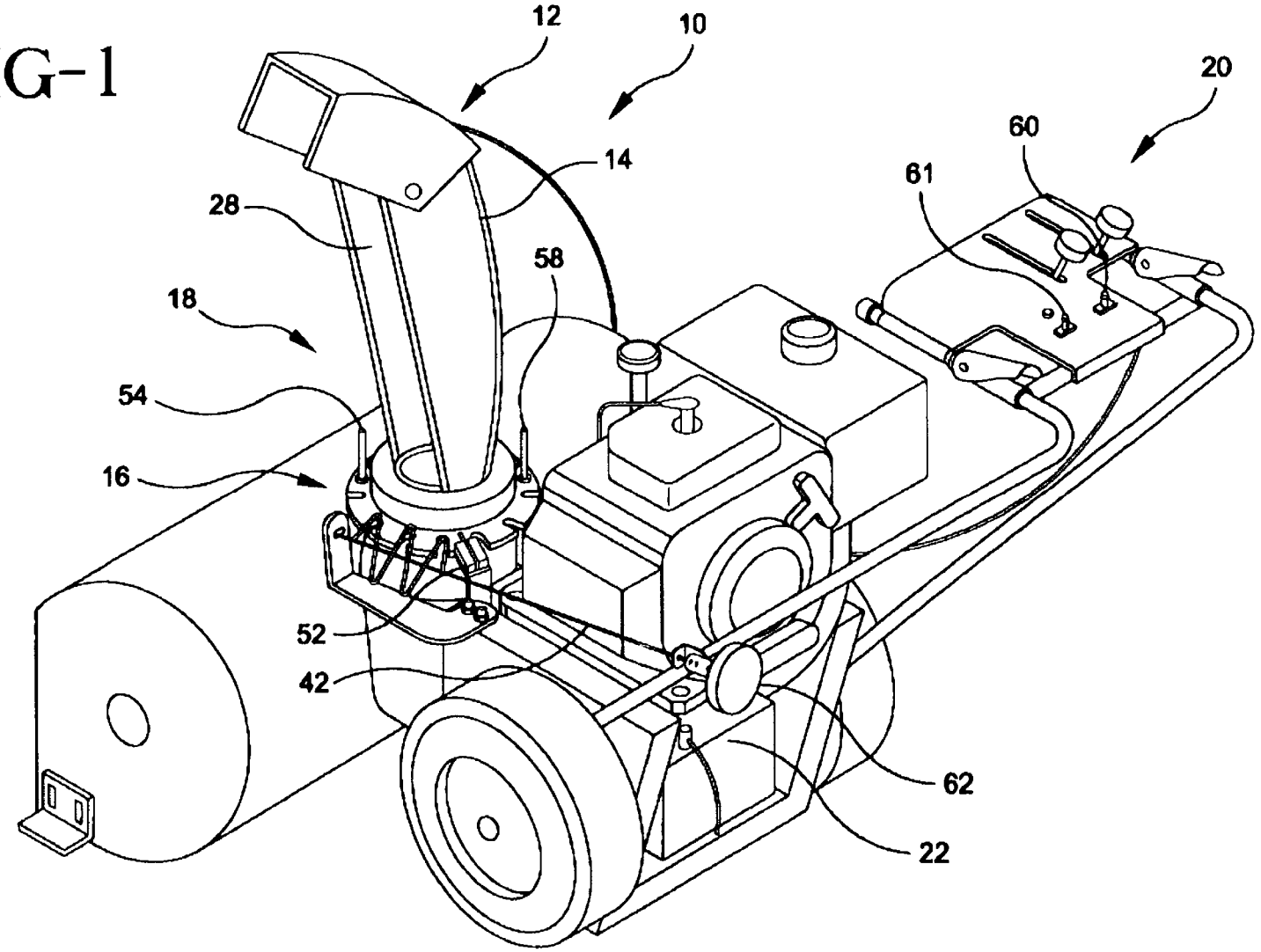
FIG. 1 is a perspective view of a snowblower having the chute assembly mounted thereon.
Figure 6:
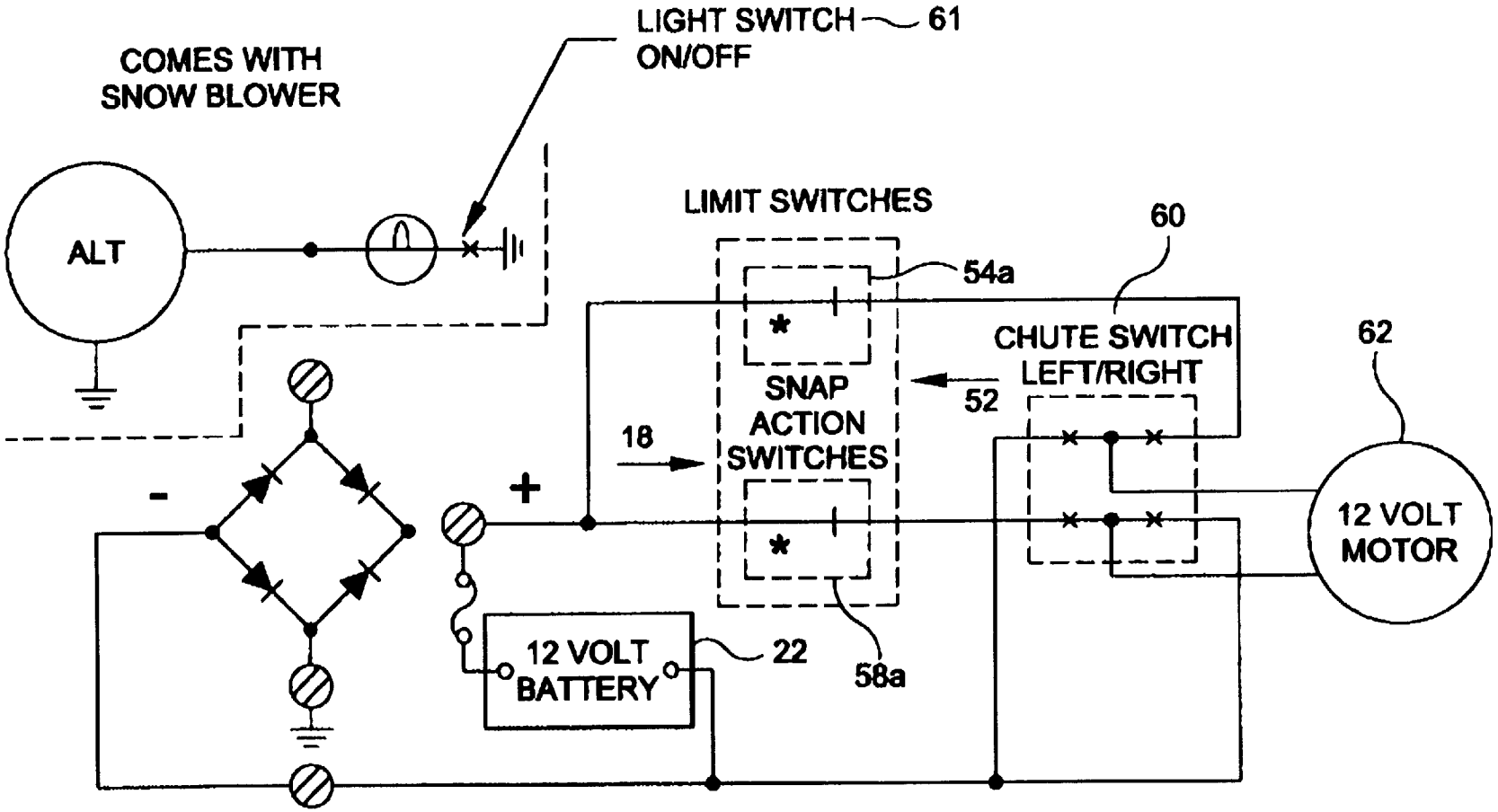
FIG. 6 is a schematic for driving the chute assembly.
Figure 1:
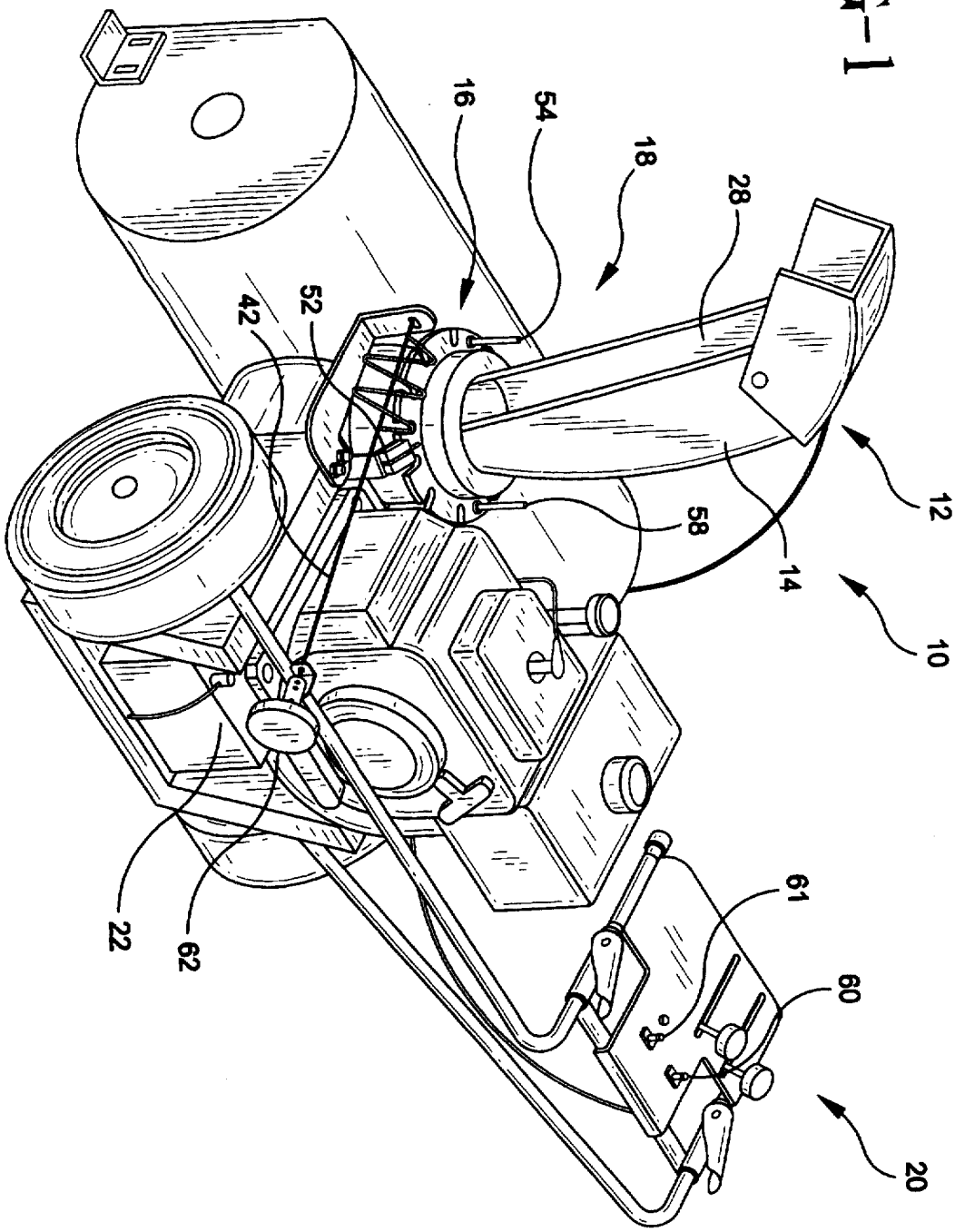
Figure 2:
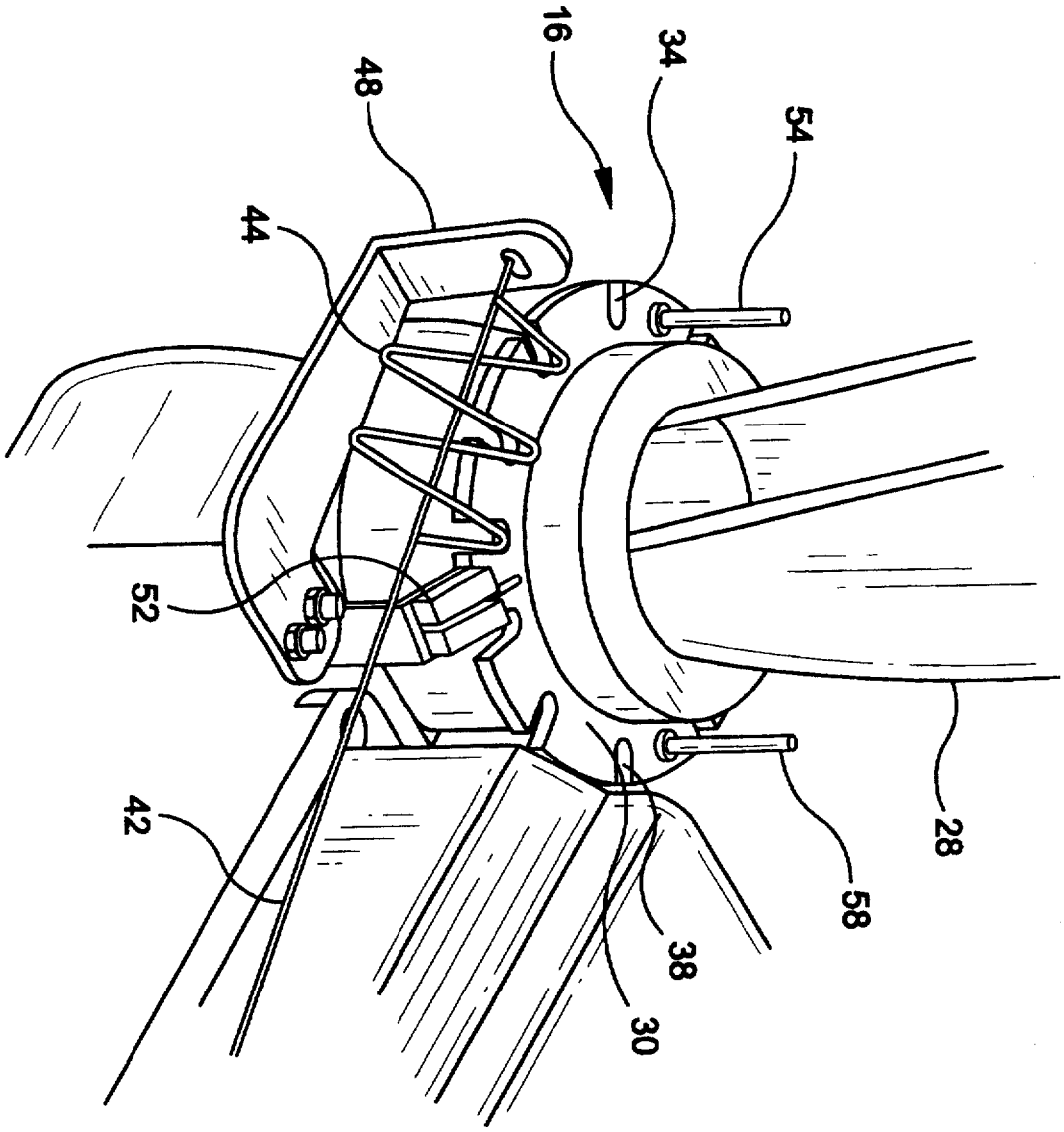
Figure 3:
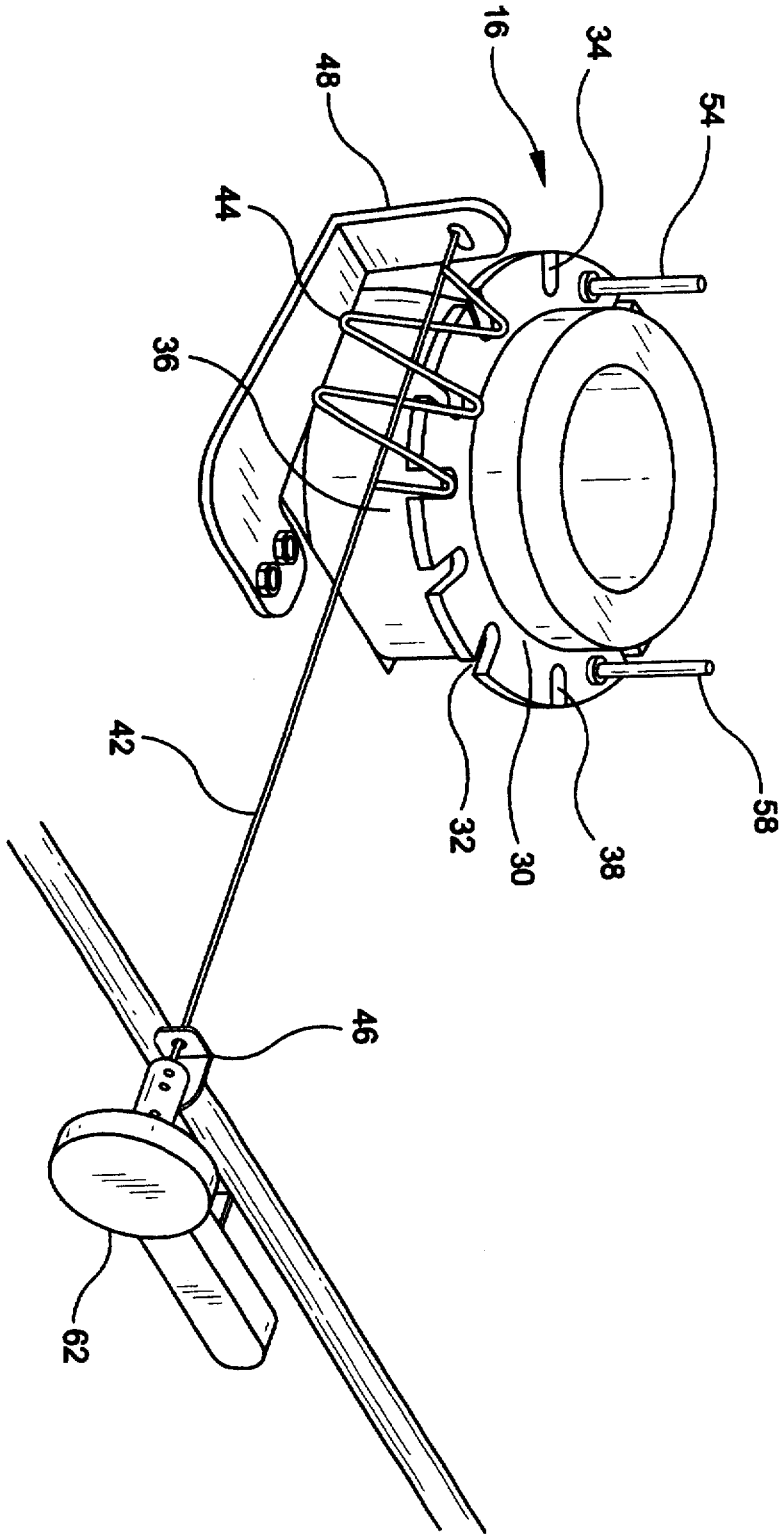
Figure 4:
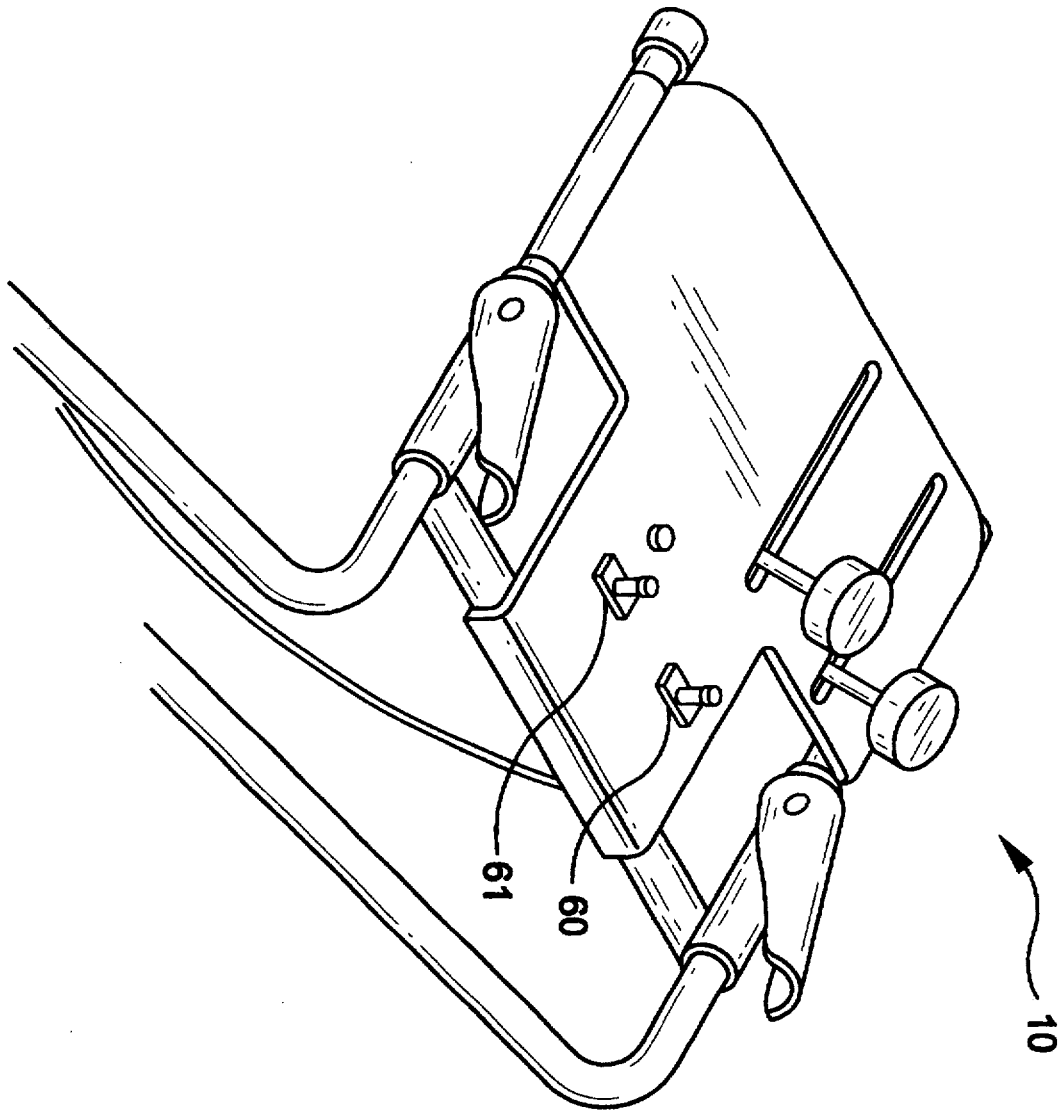
Figure 5:
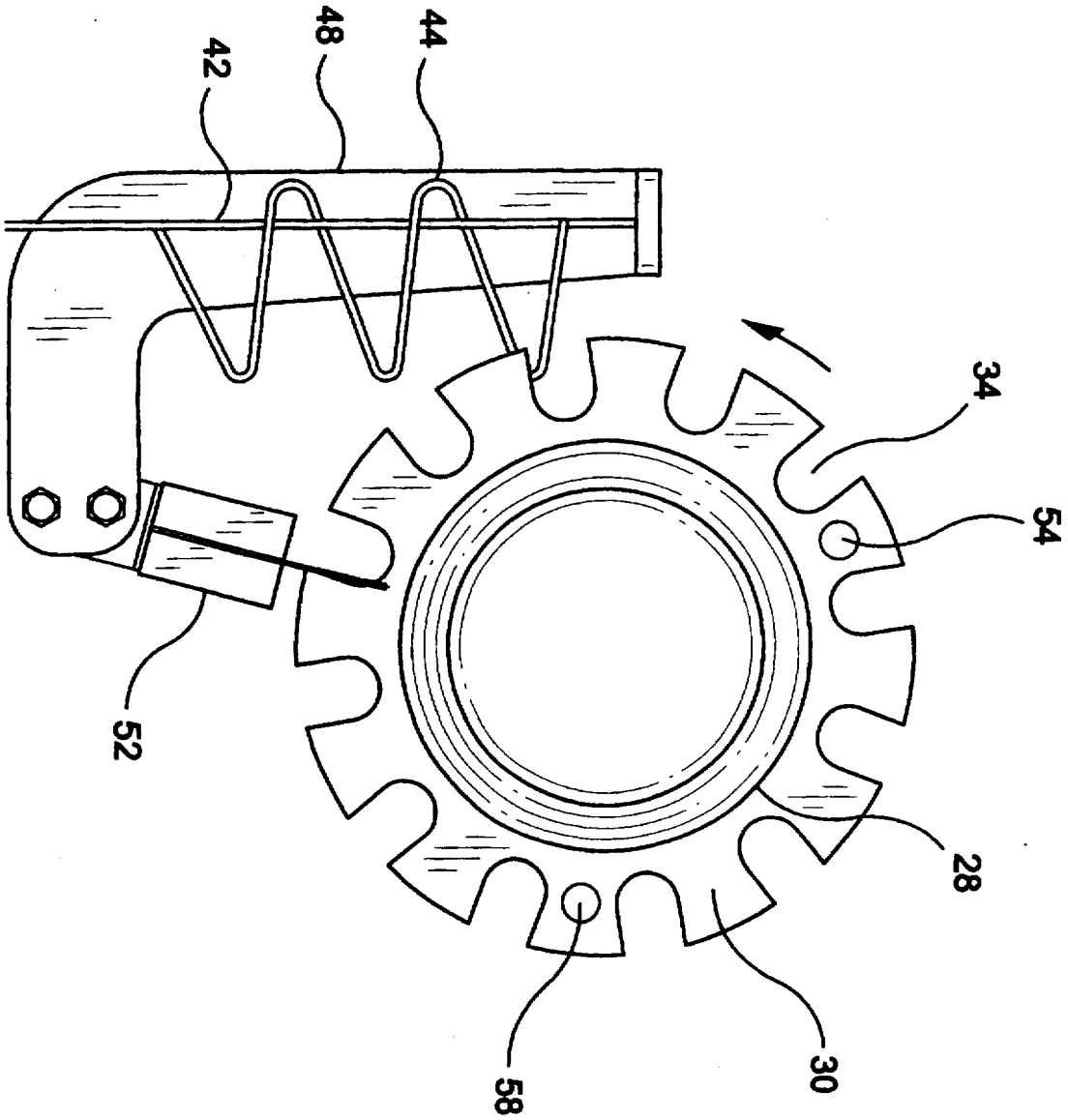
Figure 6:
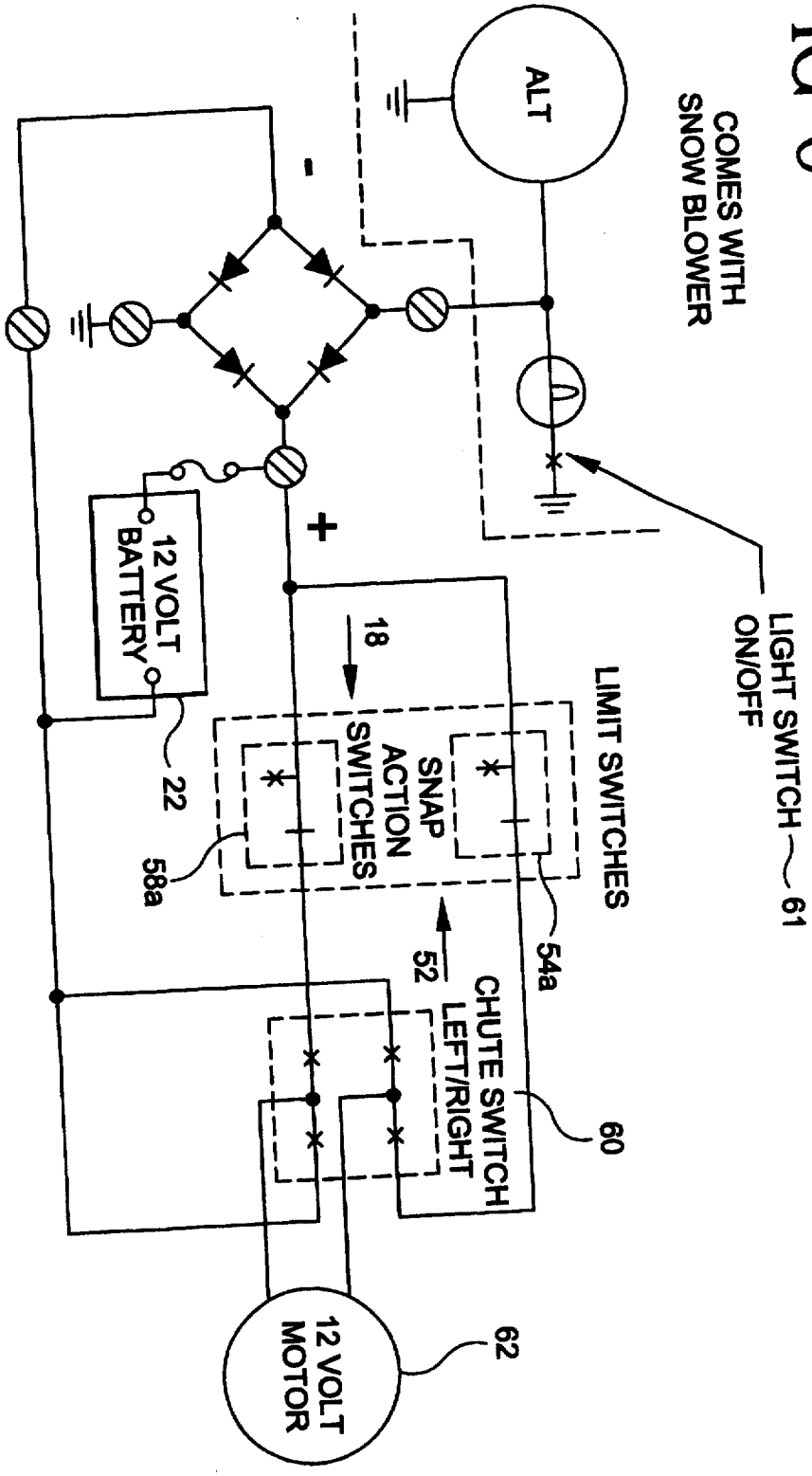

Snowblower 10 includes chute assembly 12, as seen in FIG. 1. Chute assembly 12 rotates to allow the snowblower operator to automatically select the position to which snow is to be deposited, without leaving the snowblower operating position. Rotation of chute assembly 12 is limited to prevent snow from being discharged in the direction of the snowblower operator. Chute assembly 12 is easy to assemble and use and is easily retrofitted for use with existing snowblowers. Chute assembly 12 includes snow chute 14, rotating base assembly 16, drive shaft 42, a base rotation limit assembly 18 including limit switch 52 and trip arms 54, 58 and drive control assembly 20 including a power source 22 within circuitry as shown in FIG. 6

Figure 2:
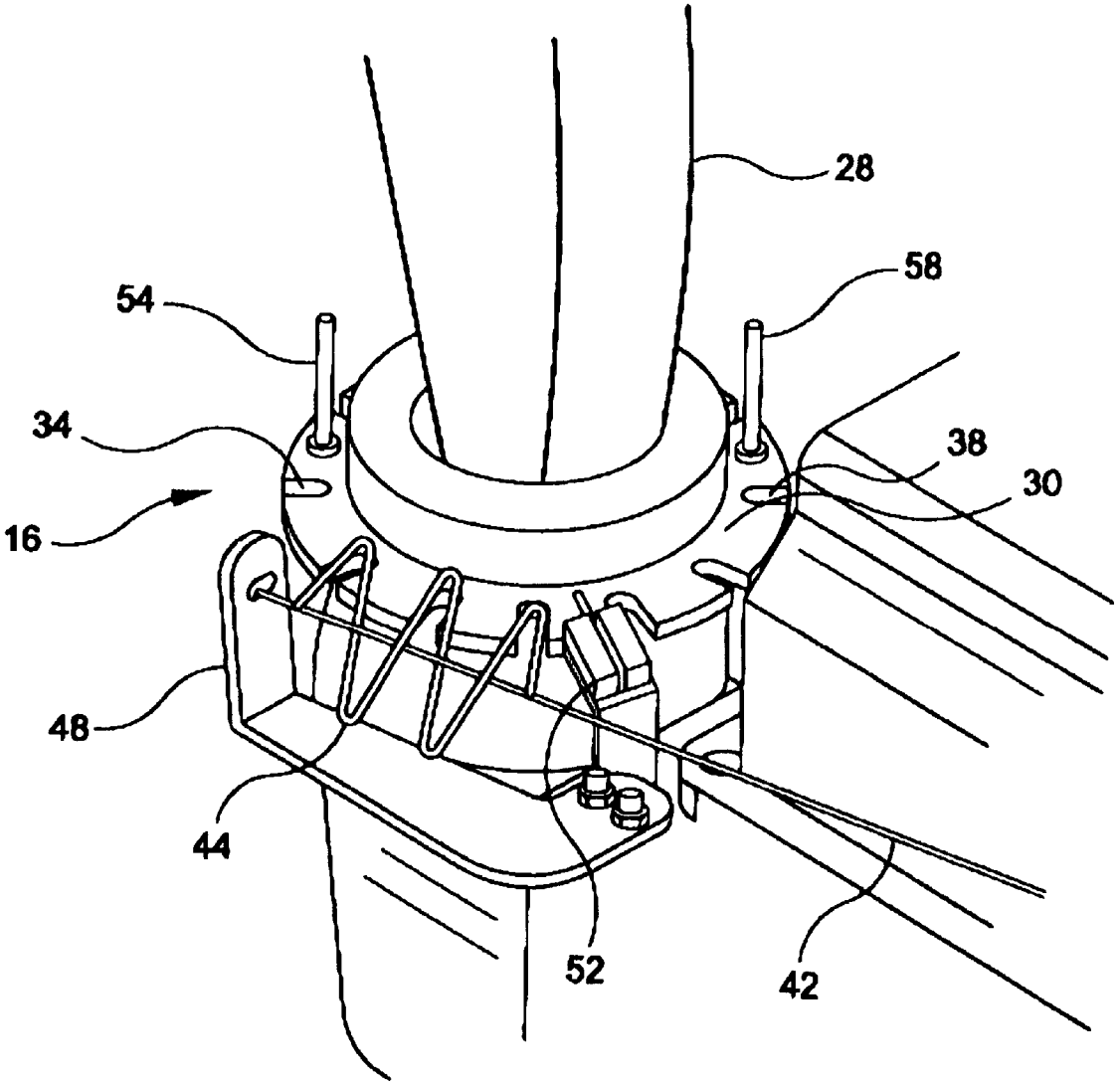
FIG. 2 is an enlarged partial perspective view of the chute assembly of FIG. I showing the worm gear and rotation limiting member.

Snow chute 14 includes body 28 attached to a circular gear-like base 30, as seen in FIGS. 1 and 2. Body 28 forms a substantially vertical conveyor rotatably attached to a snow gathering housing of snowblower 10 by base 30. Base 30 is fixedly attached to body 28 and presents a circumference through which notches 32 extend, as in FIG. 3. Notches 32 are spaced apart and extend partially around the circumference of base member 30 from a first end 34, through a mid-point 36 to a second end 38. Notches 32 aid in predetermining the extent of rotation of snow chute 14. For instance, from mid-point 36, notches 32 preferably extend 90°–105° in either direction therefrom. Thus, notches extend through an arc of 180°–210° from first end 34 to second end 38 around the circumference of base member 30. As to be described, the rotation of chute 14 will be limited to this arc so as to prevent excessive torque from being applied to rotating assembly 16.

Figure 3:
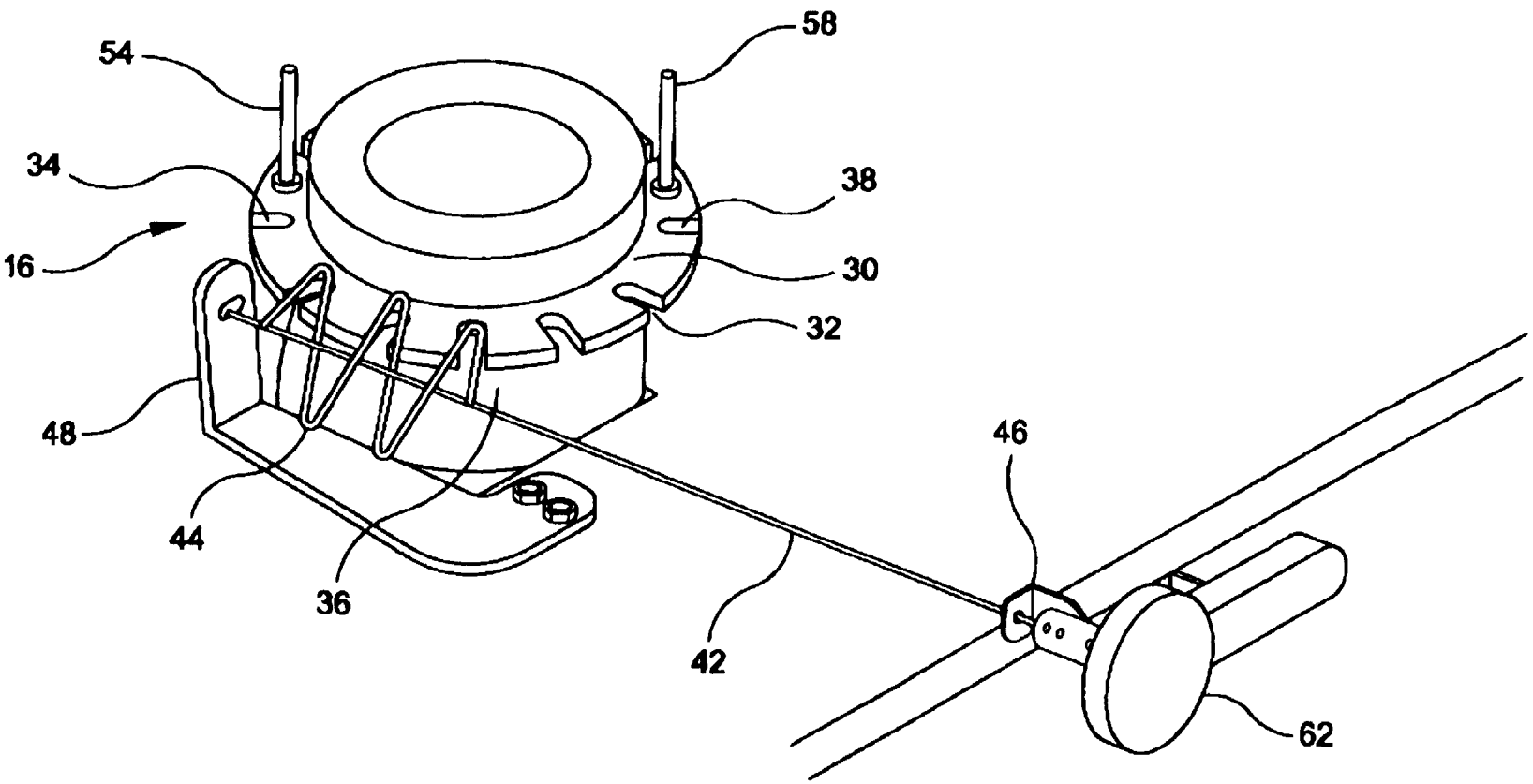
FIG. 3 is an enlarged partial perspective view of the chute assembly of FIG. I showing the worm gear and drive motor.
Figure 4:
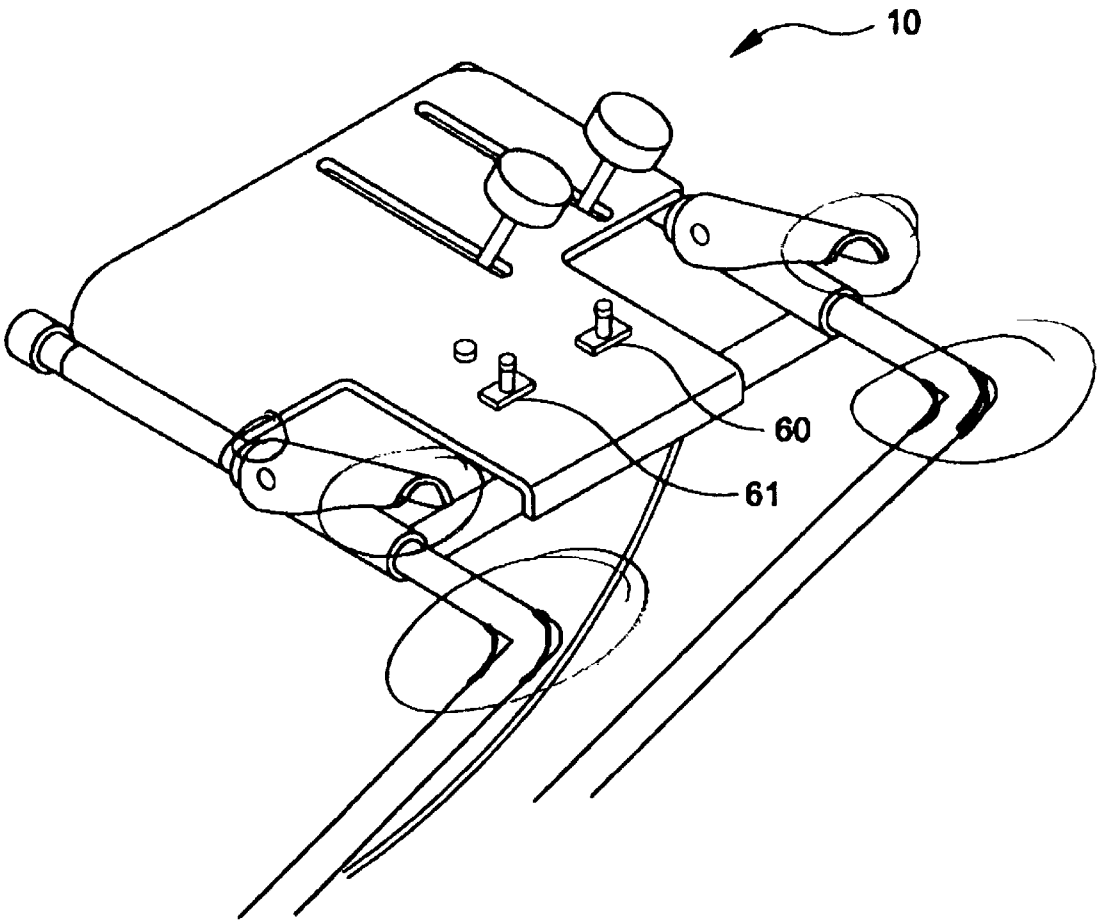
FIG. 4 is a partial perspective view of the chute direction activation switch.
Figure 5:
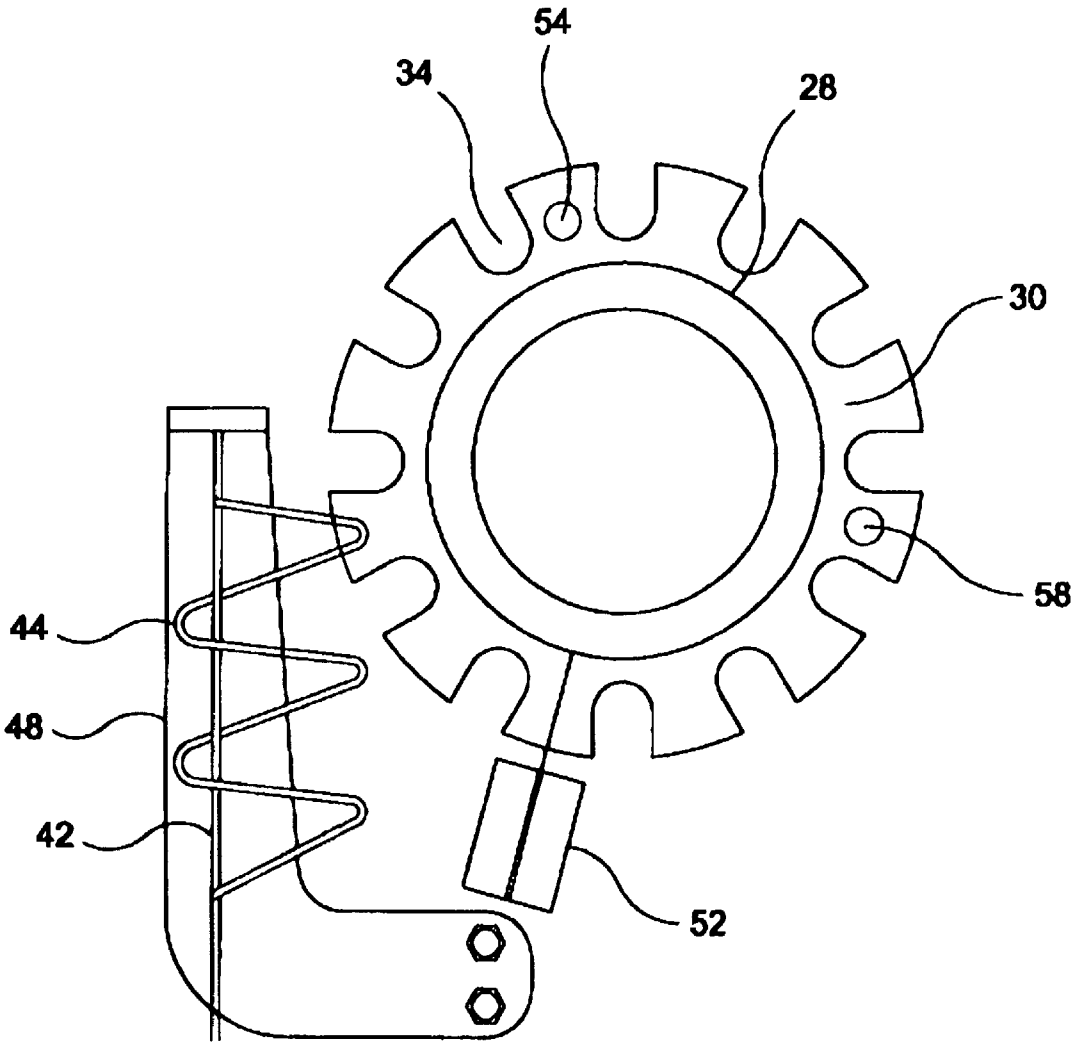
FIG. 5 is a top view showing the rotation limit assembly and worm gear.

Assembly 16 further includes drive shaft 42 to which a wire formed helical worm screw/gear 44 is fixedly mounted, as in FIG. 3. Drive shaft 42 is rotatably mounted at each end by brackets 46 and 48 to snowblower 10 and connected to drive motor 62 by conventional transmission mechanism. Worm gear 44 engages notches 32 so that upon rotation of drive shaft 42 and worm gear 44, the engaged base 30 rotates. See FIGS. 1 and 2. Specifically, when worm gear 44 rotates in a clockwise direction, base member 30 rotates in a counterclockwise direction or to the left, and when worm gear 44 rotates in the counterclockwise direction, base member 30 rotates in the clockwise direction or to the right.

Rotation limit assembly 18 precludes the snowblower operator from being covered with snow being ejected from chute 14 as well as prevents worm gear 44 from deforming due to excessive torque being applied thereto. Rotation limit assembly 18 includes limit switch 52 fixed to the snowblower and trip arms 54 and 58 on base 30 as shown in FIG. 2. Limit switch 52 is mounted and fixed at mid-point 36 of the arc of notches 32. Trip arms 54 and 58 are fixedly attached and extend from base member 30 at the ends of arc of notches. Each trip arm 54 or 58 is mounted adjacent each end 34 and 36 of notches 32, preferably a few degrees within each end 34 or 36. Thus, during rotation of base member 30

(see FIG. 2), when either trip arm 54 or 58 engages limit switch 52, switch 52 opens the circuit to prevent further rotation of base member 30 in that particular direction.

The drive assembly 18 includes circuitry having a chute direction activation switch 60 and accessory on/off switch 61 in electrical connection with battery 22 and drive motor 62. Preferably switch 60 is a double pole double throw momentary switch. Drive motor 62 is a twelve volt motor with a gear reducer that provides ample torque and low revolutions per minute with which to rotate the connected drive shaft 42 in either direction depending upon the direction switch 60 has been thrown by the operator. Switch 60 is also electrically connected to limit switch 52, and since it is a center off switch, it only activates motor when moved left or right, providing limit switch 52 is not activated. As illustrated, switch 61 controls the operation of an accessory, such as a light. Motor 62 is powered by power source 22, which is preferably a conventional 12 volt battery. See FIG. 6.

Depending upon position of switch 60 the motor will cause shaft 42 and worm screw 44 therein to rotate in either clockwise or counterclockwise directions. Accordingly, the base 30 will rotate in counterclockwise or clockwise directions as well as the chute 14 assembly thereon. Thus the user can control the position of snow discharge from chute 14.

A rotation of base 30 to the limit of the arc of notches will cause either trip arm 54 or trip arm 58 to engage limit switch 52. This will cause either an open at 54*a* or 58*a* in the circuit, the resulting open precluding further energization of motor 62 and thus rotation of base 30 beyond the limits as defined by the trip arms 54, 58. It is understood that such limits of base rotation precludes the chute 14 from being directed towards the operator.

Chute assembly controls, including limit switch 52, trip arms 54 and 58 and activation switch 60, can be easily retrofitted onto existing snowblowers (see FIG. 6) that utilize a manual hand crank for rotating the chute. The preexisting hand crank system is easily adapted into an electro/mechanical system using the existing battery and alternator. The hand crank is easily cut and modified to include the components of chute assembly 12 described herein.

It is to be understood that while a certain form of this invention has been illustrated and described, it is not limited thereto except insofar as such limitations are included in the following claims and allowable functional equilvalents thereof.

What is claimed is:

1. In combination with a snowblower having a frame assembly and a handle assembly mounted to a back portion of the frame assembly, the handle assembly having upper and lower portions, and a snow chute;

the snow chute comprising a rotatable base attached to the snowblower offset from a longitudinal midpoint of the frame assembly with the snow chute upwardly extending therefrom;

gears means attached to the snowblower for rotating said base upon a powered movement of said gear means, said gear means including a drive shaft with worm gear structure attached thereon;

means for powering said gear means for movement in first and second opposed directions, the power means including a motor mounted to the lower portion of the handle assembly and operably connected to said drive shaft and a first switch mounted on the upper portion of the handle assembly, the first switch operably connected to the motor;

a second switch mounted adjacent the rotatable base to limit rotation of said base, the second switch comprising a double throw double pole switch;

a plurality of notching partially extending about a limited portion of the base, said powered gear means engaging said notches in a manner to rotate said base in said first and second opposed directions.

2. The combination as claimed in claim 1, wherein said gear structure engages said base notches, a rotation of said drive shaft by said power means in a first direction rotating said base in said first direction with a rotation of said drive shaft in an opposed direction rotating said base in said second opposed direction.

3. The combination as claimed in claim 1, wherein said power means comprises:

an electrical circuit with said motor therein;

a power source in said circuit;

said first switch on the snowblower and in said circuit, said first switch at an on position delivering power from said source to said motor.

4. The combination as claimed in claim 3, further comprising:

means on said base for engaging said second switch during said base rotation, said engagement moving said second switch to an off position to cease said power delivery and rotation of said base.

5. The combination as claimed in claim 4, wherein said engaging means comprising first and second posts attached to said base, each said post substantially at an opposed end of said limited extension of notches, an engagement of either post with said second switch moving said second switch to an off position.

6. The combination as claimed in claim 5, wherein said notches extend about said base through an arc of approximately 180°–210°.

* * * * *

UNITED STATES PATENT AND TRADEMARK OFFICE

CERTIFICATE OF CORRECTION

PATENT NO. : 6,058,629
DATED : May 9, 2000
INVENTOR(S) : Peterson et al.

It is certified that error appears in the above-identified patent and that said Letters Patent is hereby corrected as shown below:

Column 1:
Line 18, "comers" should be — corners--.

Column 2:
Lines 2 and 5, "FIG I " should be — FIG 1--.

Column 4:
Line 7, "said gear means" should be deleted.

Title Page:
Showing an illustrative figure, should be deleted and substitute therefor the attached title page.
Delete Drawing Sheets 1-6, and substitute therefor the Drawing Sheets, consisting of FIGS. 1-6 as shown on the attached pages.

Signed and Sealed this

Seventeenth Day of July, 2001

*Attest:*

Nicholas P. Godici

*Attesting Officer*

NICHOLAS P. GODICI
*Acting Director of the United States Patent and Trademark Office*

United States Patent [19]

Peterson et al.

[11] Patent Number: 6,058,629

[45] Date of Patent: May 9, 2000

[54] SNOWBLOWER CHUTE ASSEMBLY DRIVE

[76] Inventors: Marvin W Peterson, 107 Swale Brook La., Milford, Pa. 18337; Laura M DiMarco, 54 Glen Crest Dr., Newton, N.J. 07860

[21] Appl. No.: 09/071,724

[22] Filed: May 1, 1998

[51] Int. Cl.[7] ..... E01H 5/09

[52] U.S. Cl. ..... 37/261

[58] Field of Search ..... 37/244, 246, 249; 37/250, 251, 257, 260, 261; 74/89.18, 89.19, 435

[56] References Cited

U.S. PATENT DOCUMENTS

| | | | |
|---|---|---|---|
| 3,726,029 | 4/1973 | Deen et al. . | |
| 3,760,517 | 9/1973 | Blaauw | 37/260 |
| 3,780,455 | 12/1973 | Stevenson et al. . | |
| 3,867,773 | 2/1975 | Gunderson | 37/260 |
| 3,879,866 | 4/1975 | Gunderson | 37/260 |
| 4,138,829 | 2/1979 | Chase . | |
| 4,138,831 | 2/1979 | Chase . | |
| 4,205,468 | 6/1980 | Greider . | |
| 5,315,771 | 5/1994 | White, III et al. . | |
| 5,444,927 | 8/1995 | Sosenko | 37/260 |

*Primary Examiner*—Robert E. Pezzuto

[57] ABSTRACT

A snow chute assembly for use with a snowblower. The chute assembly includes a snow chute having a rotatable base to be attached to the snowblower and presenting a circumference with spaced apart notches formed therein. An arc of notches extends around the circumference from one end, through a mid-point, through a second end preferably through an arc of 180°–210°. A gear member as driven by a drive shaft, preferably a worm gear, engages the notches. A limit switch limits the rotation of the chute on the base, the limit switch being substantially at the mid-point of the arc notches. The limit switch will engage limit arms extending from the base. One arm being at each end of the arc of notches. A base activation member includes a drive motor for rotating the drive shaft connected to the gear member, the drive shaft rotation ceasing upon engagement of the limit switch with either limit arms.

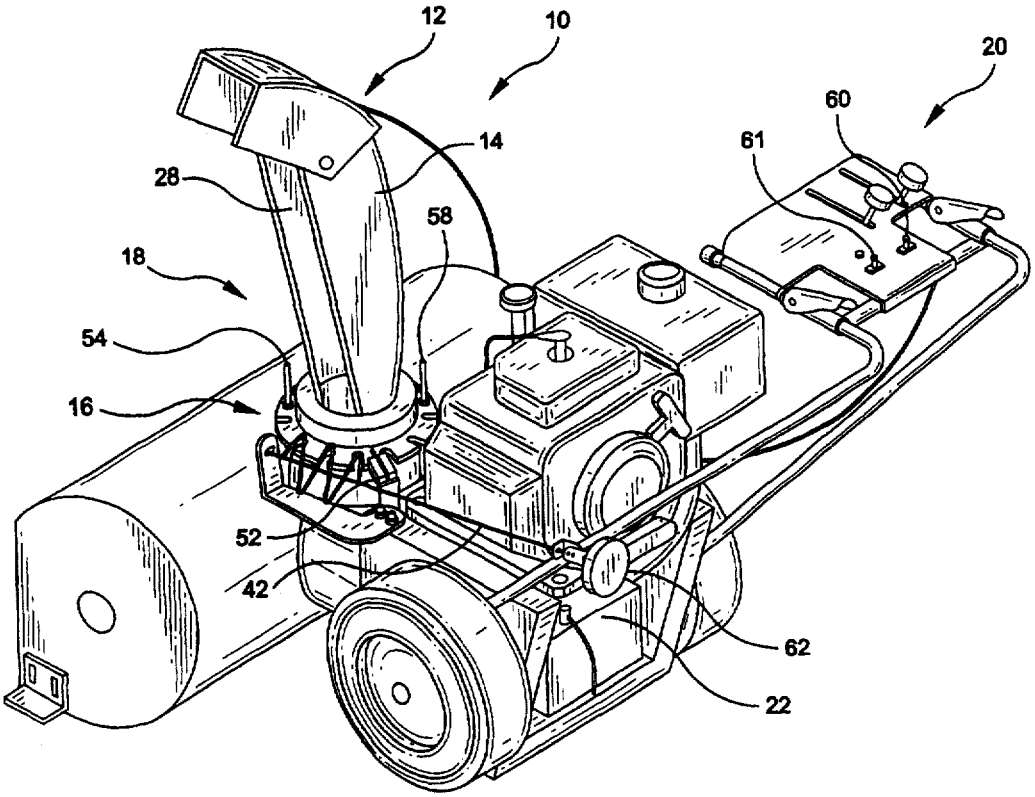

6 Claims, 6 Drawing Sheets